US007934515B1

(12) United States Patent
Towsley et al.

(10) Patent No.: US 7,934,515 B1
(45) Date of Patent: May 3, 2011

(54) BACKFLOW BONNET AND POPPET

(76) Inventors: Bryan L. Towsley, Frederick, CO (US); Charles G. Freitag, Loveland, CO (US)

( * ) Notice: Subject to any disclaimer, the term of this patent is extended or adjusted under 35 U.S.C. 154(b) by 635 days.

(21) Appl. No.: 12/047,227

(22) Filed: Mar. 12, 2008

(51) Int. Cl.
*E03C 1/10* (2006.01)

(52) U.S. Cl. ..... 137/217

(58) Field of Classification Search ..... 13/216, 13/217, 218; 137/216, 217, 218
See application file for complete search history.

(56) References Cited

U.S. PATENT DOCUMENTS

| | | | | |
|---|---|---|---|---|
| 2,159,691 | A * | 5/1939 | Fox | 137/218 |
| 2,226,350 | A * | 12/1940 | Sloan et al. | 137/218 |
| 2,927,598 | A * | 3/1960 | Thompson | 137/218 |
| 3,180,352 | A * | 4/1965 | Kersten et al. | 137/218 |
| 3,424,189 | A * | 1/1969 | Woodford | 137/218 |
| 3,565,097 | A * | 2/1971 | Costa et al. | 137/218 |
| 3,770,014 | A | 11/1973 | Limberg | |
| 3,918,477 | A * | 11/1975 | Grams | 137/218 |
| 4,284,097 | A | 8/1981 | Becker et al. | |
| 4,326,671 | A * | 4/1982 | Goguen | 239/66 |
| 4,508,137 | A * | 4/1985 | Bolgert | 137/218 |
| 4,991,655 | A | 2/1991 | McHugh | |
| 5,031,661 | A | 7/1991 | Feuz | |
| 5,176,173 | A | 1/1993 | McGarrah | |
| 5,226,441 | A | 7/1993 | Dunmire et al. | |
| 5,297,635 | A | 3/1994 | McHugh | |
| 5,413,134 | A | 5/1995 | Burgess et al. | |
| 5,794,655 | A | 8/1998 | Funderburk et al. | |
| 5,937,889 | A * | 8/1999 | Krieg | 137/218 |
| 6,114,823 | A | 9/2000 | Doner et al. | |
| 6,123,095 | A * | 9/2000 | Kersten et al. | 137/218 |
| 6,246,333 | B1 | 6/2001 | Doner et al. | |
| 6,349,736 | B1 | 2/2002 | Dunmire | |
| 6,546,946 | B2 | 4/2003 | Dunmire | |
| 6,557,576 | B2 | 5/2003 | Walrath et al. | |
| 6,578,602 | B1 | 6/2003 | Kirschner | |
| 6,832,625 | B2 | 12/2004 | Ford | |
| 6,904,931 | B2 * | 6/2005 | Stephens | 137/218 |
| 2005/0045847 | A1 | 3/2005 | Powell | |

OTHER PUBLICATIONS

FEBCO, Freeze Protection Ball Valves, Ball Valve Draining Procedure for Freeze Protection. Copyright 2005 (1 page).
FEBCO, Vacuum Breakers,(products) http://febcoonline.com/products/default.asp?parCat=1134 (2 pages), Copyright 2008.
FEBCO, Maintenance Manual Model 765, Pressure Vacuum Breaker Information Sheet (4 pages), Jun. 2001.
FEBCO, Freeze Protection Model 765, Pressure Vacuum Breaker Draining Procedure for Freeze Protection, spec. sheets. (5 pages), Copyright 2005.

* cited by examiner

*Primary Examiner* — Craig M Schneider
(74) *Attorney, Agent, or Firm* — Patent Law Offices of Rick Martin, P.C.

(57) ABSTRACT

A prior art backflow bonnet and poppet is replaced by a functionally equivalent new bonnet and poppet. The new bonnet and poppet reduces risk of freeze damage with about a 50% greater strength against pressure. The new bonnet and poppet has only three parts when assembled versus six parts in the prior art. A hollow in the valve plug holds the biasing spring. The bonnet shaft rides in the hollow.

7 Claims, 7 Drawing Sheets

BACKFLOW BONNET AND POPPET

FIELD OF INVENTION

The present invention relates to lawn sprinkler installations having a normally open to atmosphere disposable plastic valve which prevents sprinkler backflow from reaching the city water supply.

BACKGROUND OF THE INVENTION

The Febco® freeze protection Model 765 is a popular backflow prevention device. An above ground supply water extension provides a vertical path to atmosphere when the supply water is off. A first spring loaded check valve is normally spring loaded closed when the supply water is off or loses pressure while on. Above the first check valve is a plastic bonnet and poppet release valve to atmosphere. If this breaks during a freeze, it can be readily replaced. This bonnet and poppet is spring loaded open to atmosphere. The supply water pressure closes this bonnet and poppet during the sprinkling operation.

The FEBCO Series 765 Pressure Vacuum Breakers are used to protect against health hazard and non-health hazard backsiphonage conditions in industrial plants, cooling towers laboratories, laundries, swimming pools and lawn sprinkler systems.

The FEBCO 765 PVB is designed to be installed to provide protection against backsiphonage of toxic or non-toxic liquids. It consists of a spring loaded check valve which closes tightly when the pressure in the assembly drops below 1 psi or when zero flow occurs, plus, an air relief valve that opens to break a siphon when the pressure in the assembly drops to 1 psi.

Pressure Vacuum Breaker assemblies shall be installed to withstand pressure for long periods and to prevent backflow of contaminated water into the potable water system in backsiphonage conditions. The Pressure Vacuum Breaker assembly shall consist of single spring loaded check valve which closes tightly when water flow through the assembly drops to zero, and a single air relief valve that opens to break the siphon when pressure drops to 1 psi. The assembly shall include two resilient seated shut-offs and two resilient seated test cocks, considered integral to the assembly. Assemblies must be factory backflow tested. The check valve and air inlet valve must be constructed to allow in-line servicing of the assembly. The valve body shall be constructed of bronze. The check, poppet and bonnet assembly shall be constructed of engineered plastic to protect the valve body from freeze damage.

Pressure Vacuum Breaker assemblies shall be installed a minimum of 12" (300 mm) above the highest downstream outlet, and the highest point in the downstream piping. The assembly shall be rated to 150 psi working pressure and water temperature from 32° to 140° F. The assembly shall meet the specifications of the USC-FCCC & HR Manual.

FIG. 1 shows the prior art all Febco® installation 1000. Supply water line 1 has a manual shut off valve 2. An inlet drain valve 3 is used for winterization draining. A manual shut off valve 4 allows repair of a Febco® Backflow casing 5. A cap 6 vents to atmosphere. Inside the casing 5 is a disposable bonnet and poppet 2000 shown in FIG. 2. A shut off valve 7 provides water to sprinklers 8 past an outlet drain valve 10. The house exterior wall is designated 9.

If the bonnet and poppet 2000 gets frozen and breaks, then when the sprinklers are turned on, a flood will occur as shown next to the house 9. This can ruin a basement. What is needed in the art is a much stronger bonnet and poppet produced at about the same cost in order to offer the homeowner further protection from catastrophic flooding especially during fall and spring waterings when the house may be unoccupied during a quick freeze before the sprinklers have been winterized.

The present invention has over 50% improvement of the breaking strength as the prior art using about the same number of parts at about an equivalent cost to produce.

SUMMARY OF THE INVENTION

It is an aspect of the present invention to provide a disposable bonnet and poppet backflow device with improved breaking strength.

Other aspects of this invention will appear from the following description and appended claims, reference being made to the accompanying drawings forming a part of this specification wherein like reference characters designate corresponding parts in the several views.

A plastic top has male threads to mate with a metal casing. Four arch arms support a top bolt for a cap. A metal shaft extends downward from the top bolt to provide a guide for the plastic valve plug.

A normally open bias for the valve plug is provided by a metal spring resting between the valve plug and the guide. All plastic parts are made of a polycarbonate. The prior art plastic parts are made from a more brittle polysulphate nitrite. Tests show the present invention withstanding 900 psi water pressure, a fifty percent improvement over the prior art which breaks at 640 psi. City water supply pressure usually ranges from 60-100 psi, but freezing creates enormous pressures. The present invention is provided for one inch, three quarter inch, and various size backflows piping.

BRIEF DESCRIPTION OF THE DRAWINGS

FIG. 9 (prior art) is the same view as FIG. 7 showing the bonnet and poppet installed with the supply water on.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
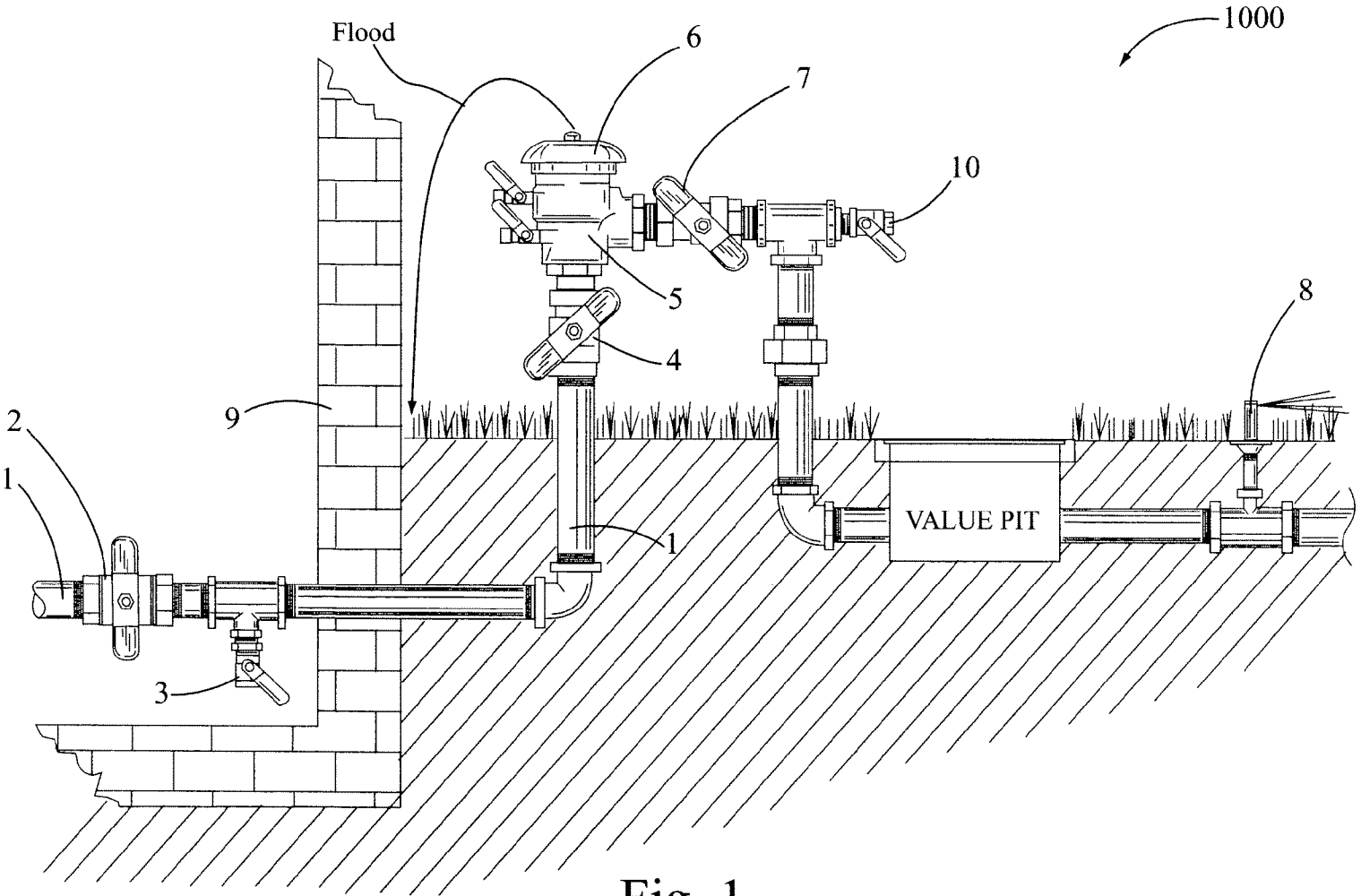
FIG. 1 (prior art) is a typical lawn sprinkler profile view.
Figure 2:
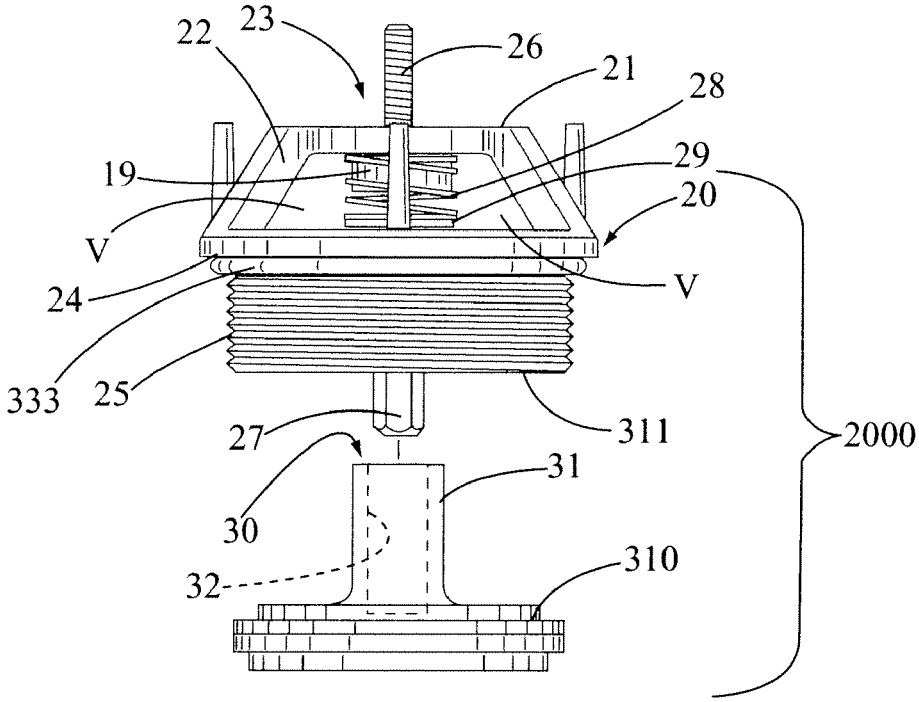
Fig. 2 (PRIOR ART)
FIG. 2 (prior art) is a side elevation view of a Febco® bonnet and poppet.

In FIG. 2 the prior art bonnet and poppet 2000 consists of an upper bonnet 20 having three plastic arch arms 21, 22, 23 rising form plastic base 24. Plastic base 24 has male threads 25. The arch arms 21, 22, 23 support a metal cap bolt 26 which is threaded to a metal plunger 27 having a hexagonal shape. A metal spring 28 abuts against a metal washer 29 which rests on a top ledge 30 of the plastic valve plug 31. Plunger 27 rides in the cylindrical hollow 32 of valve plug 31. A metal spring support 19 surrounds the cap bolt 26. Thus, the parts are the plastic valve plug 31, the washer 333, the plastic upper bonnet 20, the metal plunger 27, the metal spring 28, the metal spring support 19, the metal cap bolt 26, and the metal washer 29.

Figure 3:
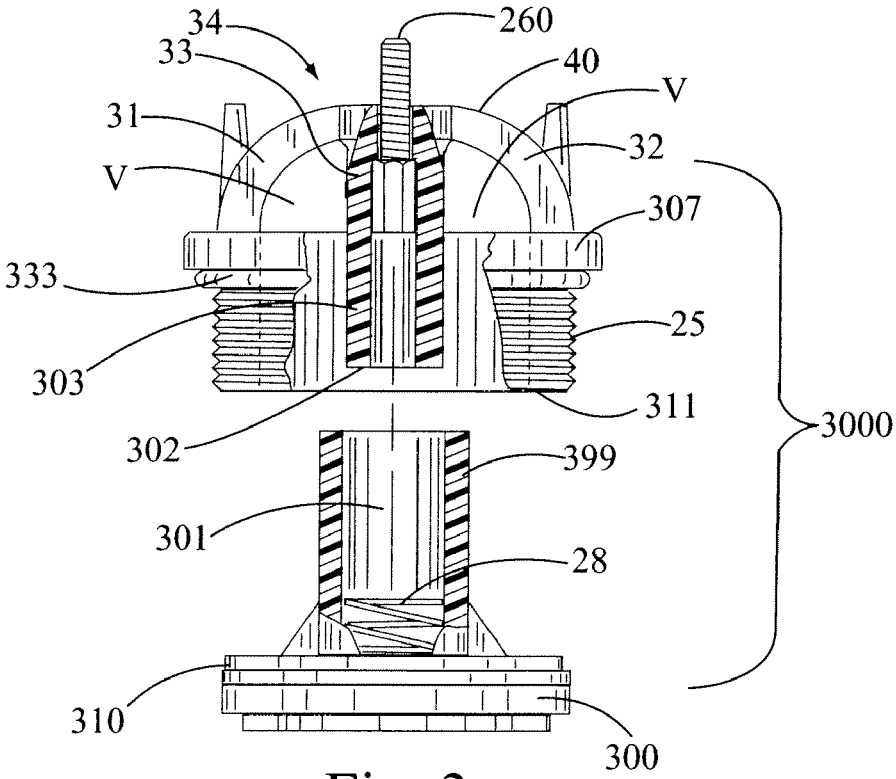
FIG. 3 is a side elevation view with partial cutaway of the present invention.
Figure 4:
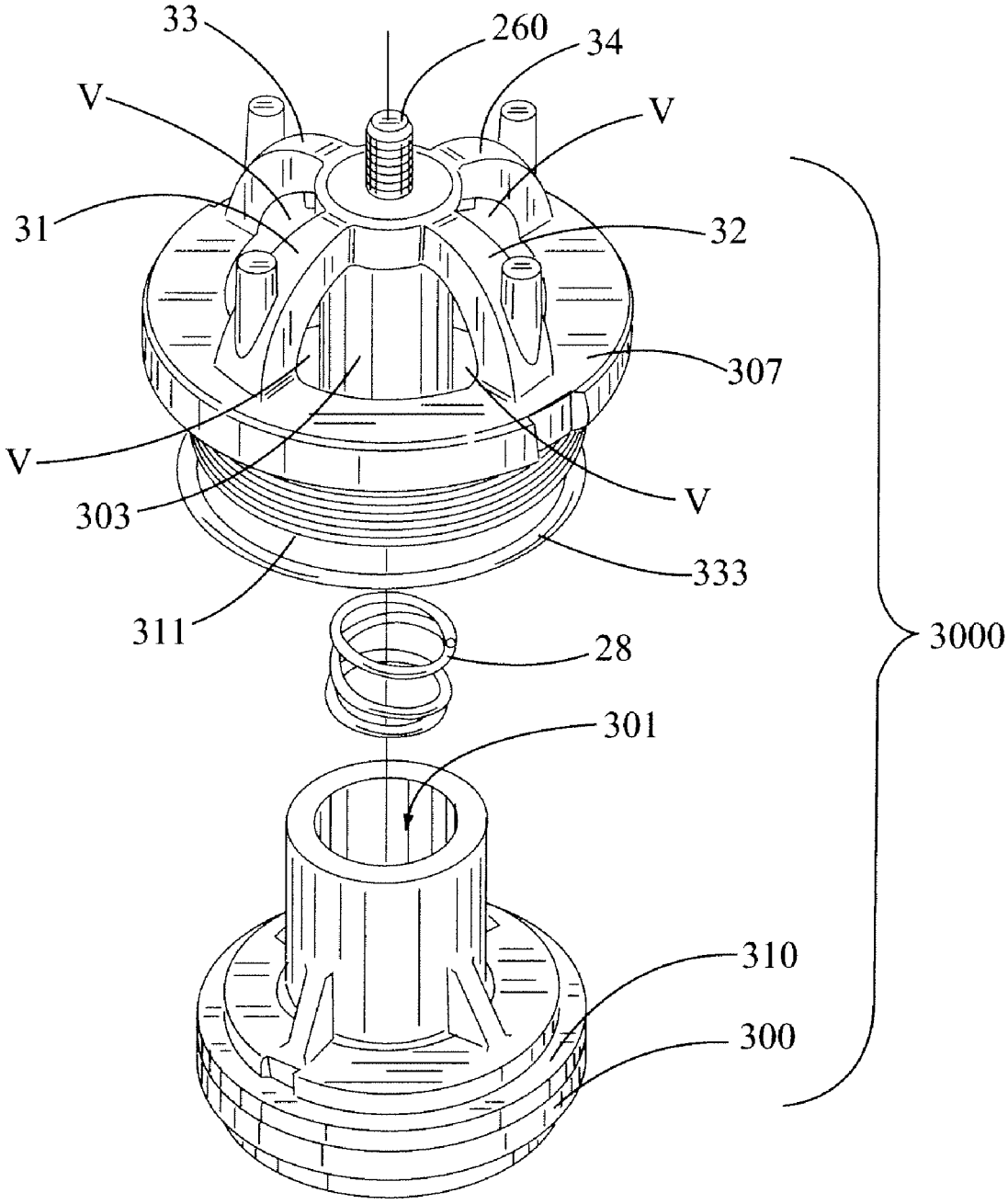
FIG. 4 is an exploded view of the embodiment view of the embodiment shown in FIG. 3 normally open.

The plastic bonnet 307 of FIGS. 3, 4 has four (or more) arch arms 31, 32, 33, 34. These arch arms support a metal cap bolt 260 and the plastic shaft 303 which slides in the hollow 301. Assembled as shown there are only three parts plus a washer 333. Everything is plastic except the cap bolt 260, the spring 28, rubber gasket valve seat 310. The valve seat 310 matches the prior art valve seat. It has an imbedded rubber top surface.

Figure 5:
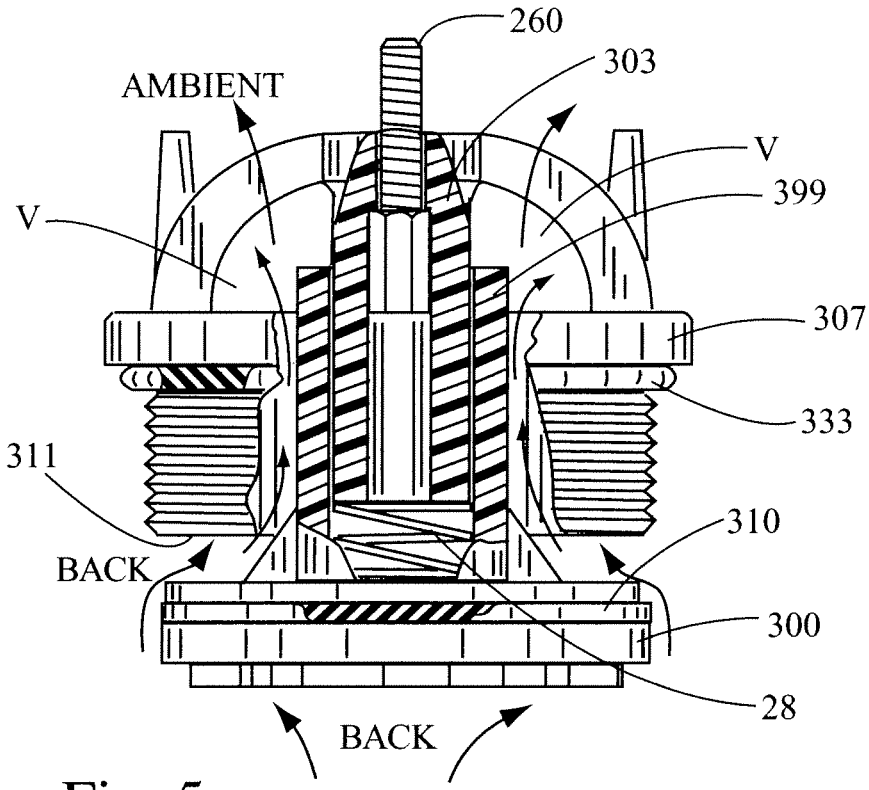
FIG. 5 is a side elevation view of the embodiment shown in FIG. 3 normally open.
Figure 8:
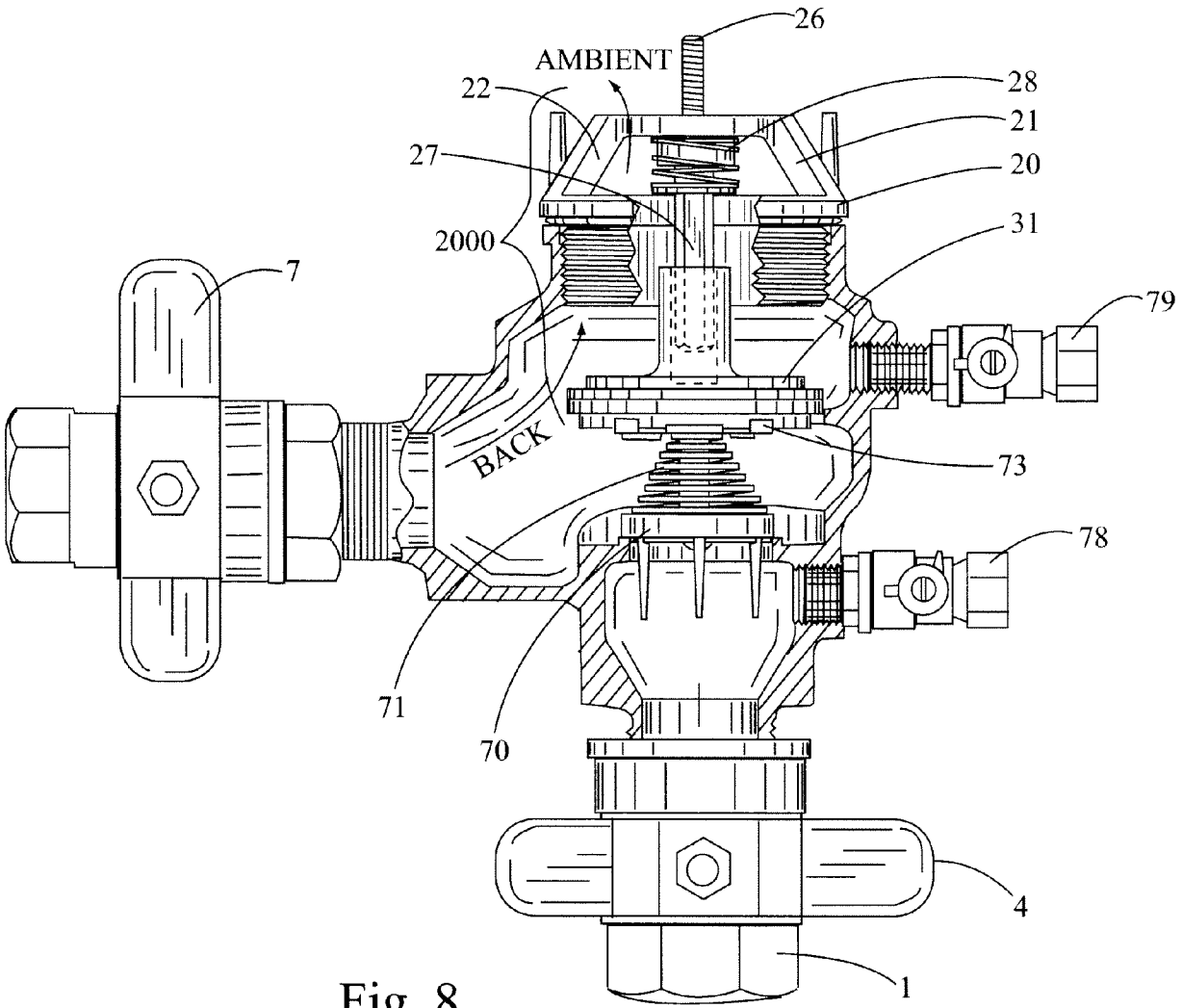
Fig. 8 (PRIOR ART)
FIG. 8 (prior art) is the same view as FIG. 7 showing the bonnet and poppet installed with the supply water off.
Figure 9:
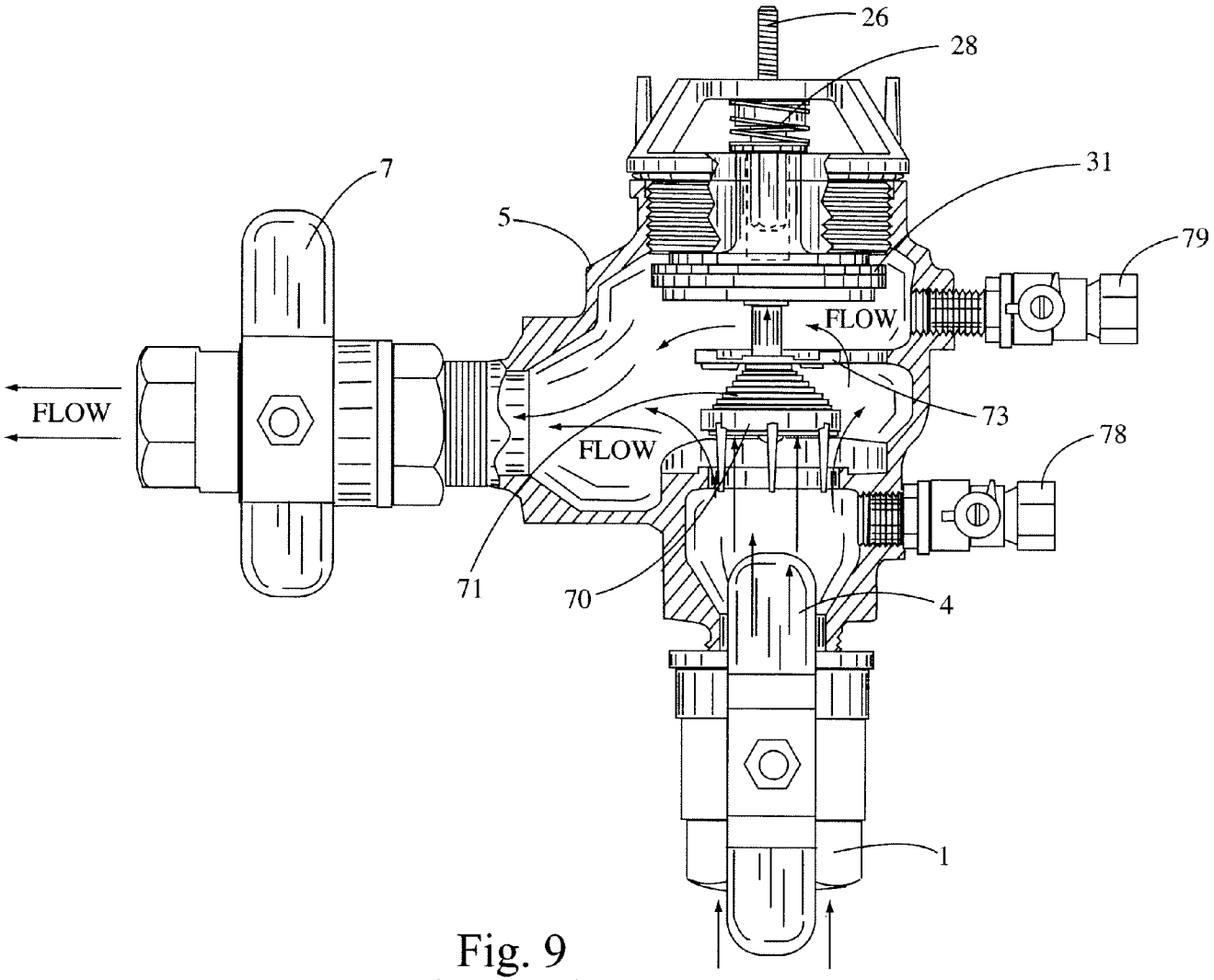
Fig. 9 (PRIOR ART)

Referring next to FIG. 5 the bonnet and poppet 3000 is functioning the same as the prior art bonnet and poppet 2000 shown in FIGS. 8, 9. Not shown is the platform 73 on which the valve plug 300 rests.

The guide wall 399 is circular in cross section forming the cylindrical hollow 301. Air and/or fluid can pass by valve plug 300 as shown by arrows BACK and pass to atmosphere per arrows AMBIENT via vents V. The spring 28 is relaxed/passive.

Figure 6:
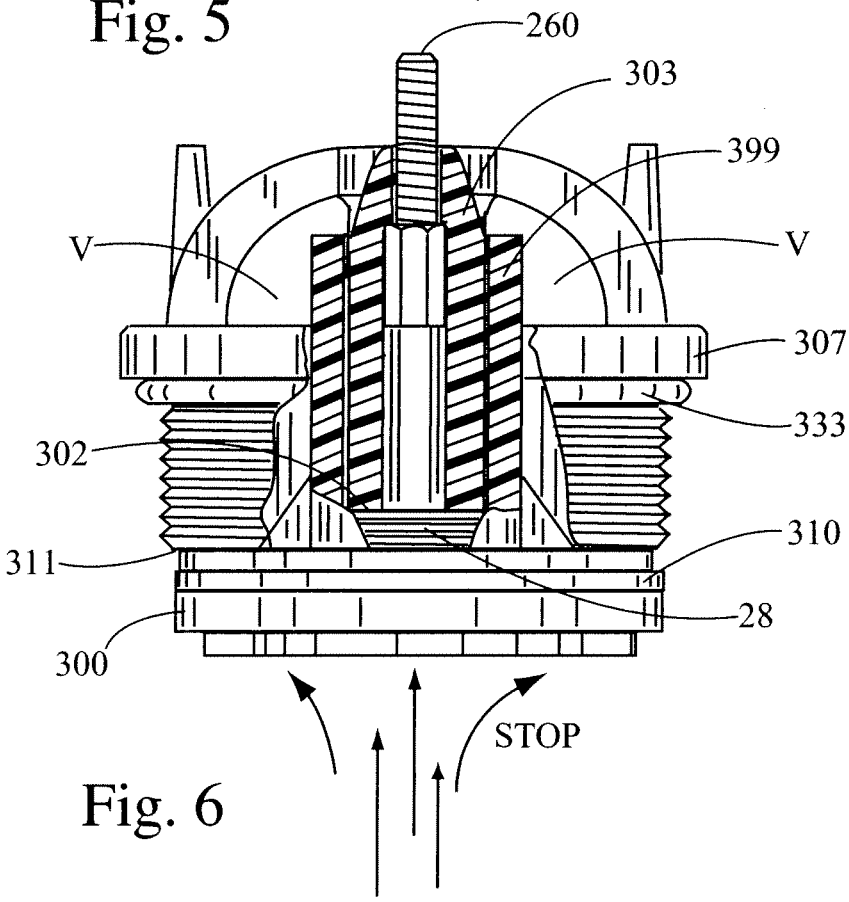
FIG. 6 is the same view as FIG. 5 showing the valve plug forced closed by supply water.

In FIG. 6 the air and/or fluid cannot pass by valve plug 300 as shown by arrows STOP. The spring 28 is compressed by the pressure of supply water shown by arrows STOP. The guide wall 399 has traveled up the outside of shaft 303. Valve seat 310 has sealed vents V. The lower peripheral edge 311 of the bonnet serves as the upper valve seat for valve seat 310. The bottom ledge 302 anchors the spring 28, thus biasing the valve plug 300 downward against the supply water pressure shown by arrows STOP. A metal cap (not shown) is bolted onto cap bolt 260.

Figure 7:
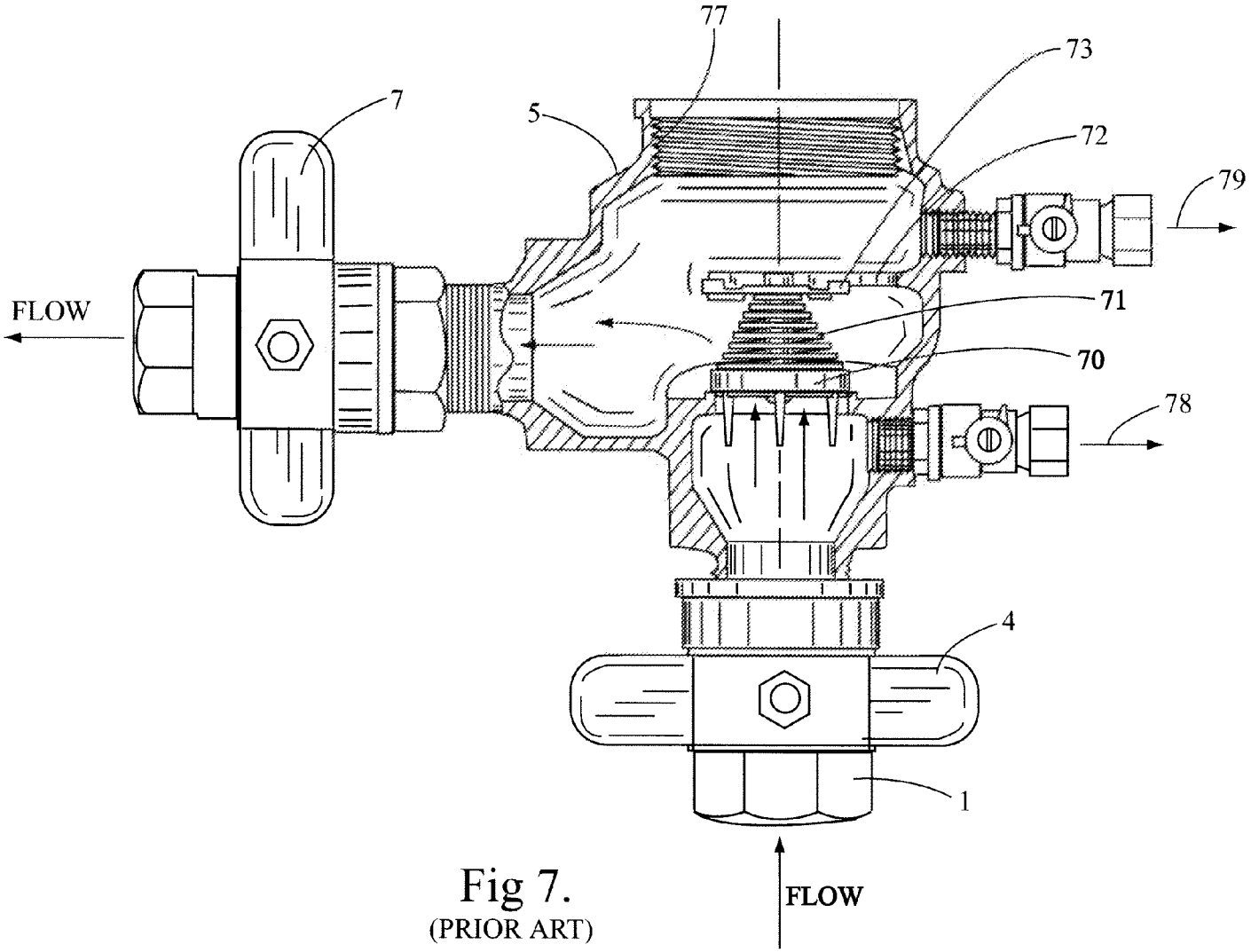
Fig 7. (PRIOR ART)
FIG. 7 (prior art) is a longitudinal sectional view of the casing 5 shown in FIG. 1.

Operational views of bonnet and poppet 2000 are shown in FIGS. 7, 8, 9.

Referring next to FIG. 7 the casing 5 is connected to the vertical supply pipe 1. Check valve 70 is biased closed by spring 71. The spring 71 is anchored against ledge 72 inside casing 5. Platform 73 is metal, and it supports the bonnet and poppet 2000. Arrow FLOW shows water flow when the system is open. Ports 78, 79 are test ports. Threads 77 accept threads 25 of FIG. 2.

Referring next to FIG. 8 the valve plug 31 rests atop platform 73. The supply water is off. Spring 28 biases valve plug 31 open, thereby providing any backflow fluid shown by arrow BACK to escape to atmosphere shown by arrow AMBIENT. Spring 71 biases check valve 70 normally closed.

Referring next to FIG. 9 shut off valve 4 is open, and arrows FLOW indicate the flow. The fluid passes by check valve 70 and compresses spring 71. Then the fluid forces the valve plug 31 closed, compressing spring 28 as shown. If the supply pressure drops enough, then the check valve 70 closes, and the valve plug 31 opens allowing any backflow water to escape to atmosphere.

Referring next to FIGS. 3, 4, the bonnet and poppet 3000 functions in the same manner as described above for the prior art bonnet and poppet 2000. Metal spring 28 urges the valve plug 300 down in the normally open position. Threads 25 are the same as the prior art and suited for various sizes. Spring 28 sits at the bottom of cylindrical hollow 301. Bottom ledge 302 of plastic shaft 303 rests atop the spring 28.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. An atmospheric release valve comprising:

an upper bonnet having male threads to engage a port to atmosphere in a backflow device;

said upper bonnet having at least four raised arch arms which support a cylindrical central shaft and provide a plurality of atmospheric vents between adjoining arch arms;

said central shaft having a bolt extension for a cap;

said cylindrical central shaft having a bottom which is sized to be received by a cylindrical guide;

said cylindrical guide having a hollow central cavity sized to receive the cylindrical central shaft, and having a spring located at a bottom of the central cavity functioning to bias the cylindrical central shaft away from the bottom of the central cavity; and said cylindrical guide connected to a circular base that has a valve seat on an upper ledge of its peripheral circumference.

2. The release valve of claim 1, wherein the bolt extension and the spring are made of metal, the valve seat is rubber, a washer fits around the male threads, and all other parts are made of plastic.

3. The release valve of claim 2, wherein a lower peripheral edge of the upper bonnet male threads provides an upper valve seat for the rubber valve seat.

4. An atmospheric release valve comprising:

a plastic upper bonnet having a lower portion with male threads to engage an atmospheric port of a backflow device;

said plastic upper bonnet having at least four raised arch arms which support a plastic, cylindrical central shaft and provides vents to atmosphere;

a plastic valve plug having an upper, cylindrical guide wall that reciprocates up and down around the cylindrical central shaft;

said plastic valve plug having a top peripheral ledge which forms a lower valve seat against an upper valve seat consisting of a lower peripheral edge of the male threads of the plastic upper bonnet;

said upper, cylindrical guide wall having a spring at its bottom;

wherein said spring biases the plastic valve plug away from the cylindrical central shaft of the plastic upper bonnet; and wherein a supply water pressure under the plastic valve plug overcomes the spring bias and closes the lower valve seat against the upper valve seat.

5. The apparatus of claim 4, wherein the plastic upper bonnet further comprises a bolt for a cap.

6. The apparatus of claim 4, wherein the top peripheral ledge of the plastic valve plug has a rubber surface.

7. The apparatus of claim 6 further comprising a washer around the male threads of the plastic upper bonnet.

* * * * *